US005363522A

United States Patent [19]

McGraw

[11] Patent Number: 5,363,522

[45] Date of Patent: Nov. 15, 1994

[54] SPRING ASSEMBLY AND PERIMETER SUPPORT SPRING THEREFOR

[75] Inventor: Kevin N. McGraw, Micaville, N.C.

[73] Assignee: Hickory Springs Manufacturing Company, Hickory, N.C.

[21] Appl. No.: 204,546

[22] Filed: Mar. 2, 1994

[51] Int. Cl.[5] ..... A47C 27/04

[52] U.S. Cl. ..... 5/474; 5/260; 267/96; 267/102; 267/107

[58] Field of Search ..... 5/474, 476, 259.1, 260; 267/95, 96, 97, 102, 103, 105, 107

[56] References Cited

U.S. PATENT DOCUMENTS 2,709,819 6/1955 Wise ..... 5/260
2,857,603 10/1958 Rymland ..... 5/260
3,992,853 11/1976 Morris ..... 5/259.1
4,003,563 1/1977 Taylor ..... 5/259.1 X
4,101,992 7/1978 Levine et al. .
4,114,210 9/1978 Levine et al. .
4,326,311 4/1982 Paripovich .
4,796,872 1/1989 Hagemeister .
4,867,423 9/1989 Marsh .
5,062,172 11/1991 Stewart .
5,265,291 11/1993 Callaway ..... 5/260 X

*Primary Examiner*—Michael F. Trettel
*Attorney, Agent, or Firm*—Shefte, Pinckney & Sawyer

[57] ABSTRACT

A perimeter support spring for use in a mattress or furniture spring assembly having an array of coil springs connected with spaced parallel border wires along the perimeter of the spring array is connected between the border wires to provide supplementary support to the mattress perimeter. The support spring comprises a torsion spring member having an intermediate torsion coil, a pair of spring arms diverging from the torsion coil, and a pair of molded plastic mounting clips attached to the terminal ends of the spring arms.

17 Claims, 4 Drawing Sheets

SPRING ASSEMBLY AND PERIMETER SUPPORT SPRING THEREFOR

BACKGROUND OF THE INVENTION

The present invention relates generally to spring assemblies of the type formed with an array of coil springs, such as used in mattresses, furniture, and the like, and more particularly to a support spring for attachment to the perimeter of a mattress spring assembly to provide supplementary support thereat.

Bedding and like mattresses typically comprise a wire spring assembly encased within foam or fiber padding and an outer fabric covering. The spring assembly is normally formed of an array of coil springs arranged in longitudinal and transverse rows and border wires at the top and bottom of the spring array with the springs and border wires being integrated by a series of helical wires connecting the upper and lower coils of adjacent spring rows and also connecting the border wires to the upper and lower coils of the springs along the outer perimeter of the spring array. It is also common practice to provide a series of additional support springs between the border wires at spacings along the perimeter of the spring assembly to provide supplementary stiffness and support around the outer lateral edges or perimeter of the mattress, making the edges of the mattress stiffer and more comfortable for sitting.

Disadvantageously, the fabrication of a mattress spring assembly of the described type is labor intensive, particularly in the application of the helical connecting wires to connect the spring array to the border wires, causing many bedding assembly workers to experience Carpal Tunnel Syndrome and like cumulative trauma disorders to the musculature of the hands, wrists and lower arms. One acceptable alternative, which also may provide some improvement in the overall performance of the spring assembly, is to utilize discrete metal clips or bands, sometimes commonly referred to as "butterfly" clips at individual attachment locations between the perimeter springs and the border wires. The use of such clips, however, has met with resistance within the bedding industry because the helical wires have also been typically utilized to secure in place the perimeter support springs between the border wires of the spring assembly.

One attempt to address the problem of attaching mattress edge support springs when metal connector clips are used instead of a helical wire connector between the mattress border wires and the perimeter springs of the mattress, is disclosed in U.S. Pat. No. 5,062,171. This patent discloses an edge support spring fabricated entirely of a single strand of spring wire fashioned into a central torsion spring from which opposing springs arms extend outwardly, with the opposite ends of the spring arms being bent into the form of a U-shaped clip which may be snap-fit onto the border wires of a mattress spring assembly. One disadvantage of this edge support spring is the degree of bending required to form the clip portion at the opposite ends of each spring arm of each edge support spring, which necessitates a relatively complicated bending fixture.

SUMMARY OF THE INVENTION

It is accordingly an object of the present invention to provide an improved perimeter support spring for bedding mattresses which is of a simplified construction. A more particular object of the present invention is to provide a mattress edge support spring utilizing molded plastic clips which may be attached to the opposite ends of a wire torsion spring to substantially minimize the bending required to fashion the wire spring.

Basically, the perimeter support spring of the present invention is intended for use in substantially any mattress, furniture spring assembly or the like of the type comprising an array of interconnected coil springs with upper and lower border wires connected in spaced parallel relation to the coil springs along the lateral perimeter of the spring array. Briefly summarized, the perimeter support springs of the present invention comprises a spring member having an intermediate spring element, e.g., a torsion coil, and a pair of spring arms extending in diverging directions from opposite ends of the spring element to respective terminal arm ends. A pair of mounting clips are attached respectively to the terminal arm ends of the spring arms, with each clip having a first attachment portion receiving the respective terminal arm end and a second attachment portion for receiving a respective border wire in a spring assembly.

In the preferred embodiment, each mounting clip is molded from a suitable thermoplastic material in an L-shaped configuration wherein the first and second attachment portions are generally transverse to one another. The spring member is fashioned with the terminal arm end of each spring arm oriented generally perpendicularly to the spring arm. The first attachment portion of each mounting clip defines a first opening receiving the respective terminal arm end and a first channel receiving the respective spring arm. The second attachment portion of the mounting clip defines a second channel generally transverse to the first channel of the first attachment portion for receiving the respective border wire. Preferably, the terminal arm ends of each perimeter support spring extend in opposite directions to one another so that the spring is symmetrical and is better enabled to resist twisting forces.

It is further preferred that the second attachment portion of each mounting clip be offset from the first attachment portion so that the channel of the second attachment portion is out of alignment with the spring arm received by the first attachment portion. In this manner, the terminal arm ends of the spring arms and the border wires are held by the mounting clips of the invention in general alignment with one another in a common plane when the perimeter of a mattress spring array is uncompressed and during an initial stage of mattress compression.

According to another feature of the invention, the channel of the second attachment portion of each mounting clip is configured to permit relative rotation of the mounting clip about the border wire received therein during compression and decompression of the perimeter of the spring array, while the first attachment portion of each mounting clip, on the other hand, serves to maintain the clip essentially rigid with respect to the respective spring arm of the spring member. In this manner, the channel of the second attachment portion is constrained to face the spring array when the perimeter of the spring array is uncompressed and to rotate relative to the respective border wire during compression of the perimeter of the spring array to face oppositely to the direction of the compressive force. Thus, compressive forces on the perimeter of the spring assembly urge the border wires into the respective channels of the mounting clips of each perimeter support spring to resist detachment from the border wires.

DESCRIPTION OF THE PREFERRED EMBODIMENT

Figure 1:
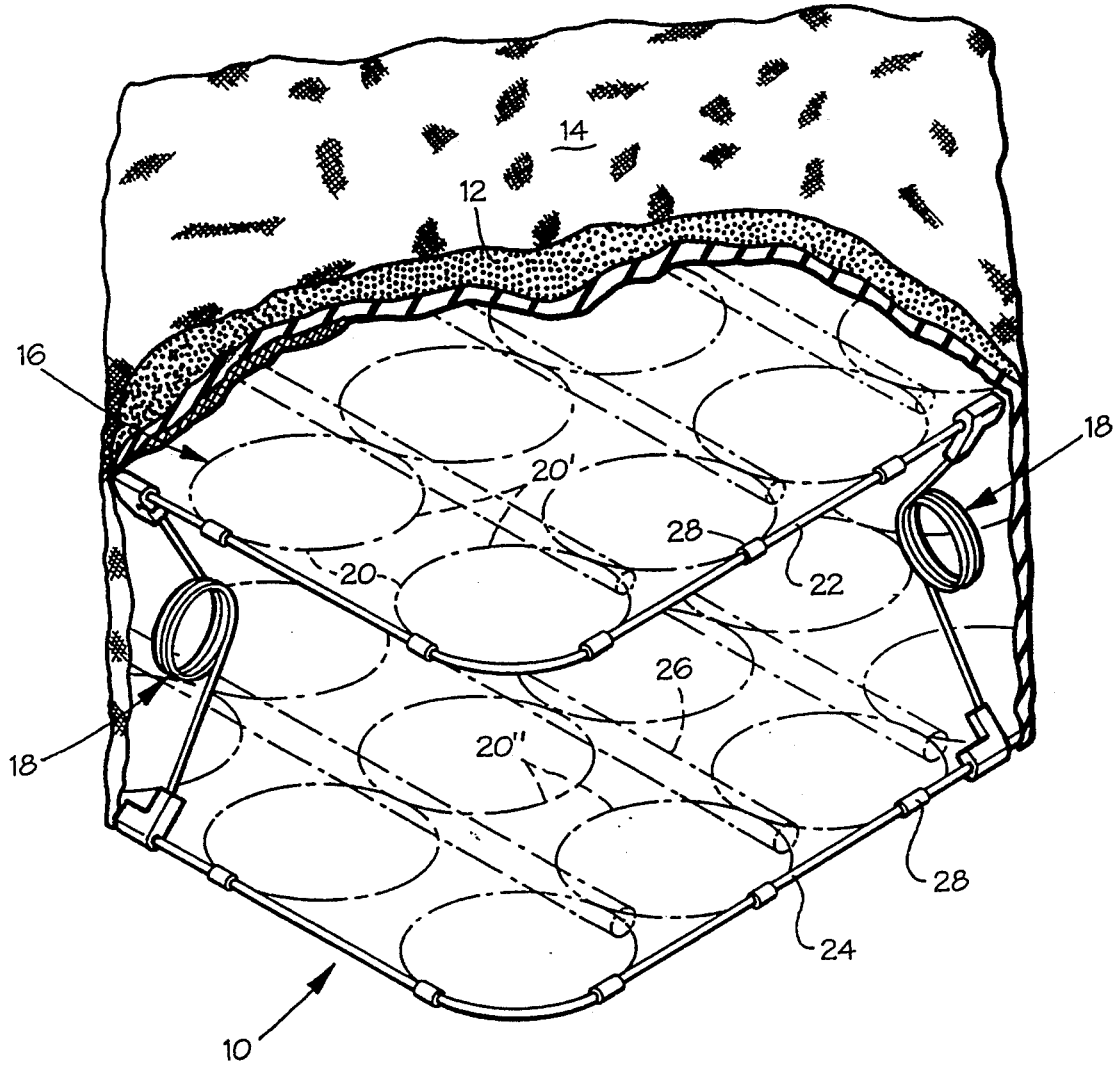
FIG. 1 is a perspective view, partially broken away, of a bedding mattress, showing the preferred embodiment of the perimeter support spring of the present invention.

Referring now to the accompanying drawings and initially to FIG. 1, a corner section of a mattress 10 is illustrated with its foam padding 12 and fabric covering 14 broken away to illustrate the interior spring assembly 16 with perimeter support springs 18 in accordance with the present invention secured thereto. However, while the present invention is herein described with respect to the mattress 10, those persons skilled in the art will recognize and understand that the present invention is not so limited but is equally adapted to use in other forms of spring assemblies, such as those used in furniture and the like.

The spring assembly 16 of the mattress 10 is substantially conventional, having a plurality of coil springs 20 arranged in axially parallel side-by-side relation in linear rows with the respective upper and lower terminal coils 20',20" of the coil springs 20 essentially co-planar with one another. An upper rectangular border wire 22 and a corresponding lower rectangular border wire 24 extend about the perimeter of the spring assembly 16 essentially co-planar with the upper and lower coils 20',20" of the coil springs 20. The upper and lower coils 20',20" of the coil springs 20 of adjacent rows are connected to one another by helical wires 26, while the border wires 22,24 are connected respectively to the upper and lower coils 20',20" of the coil springs 20 along the outer perimeter of the spring assembly 16 by metal bands or clips 28.

Figure 2:
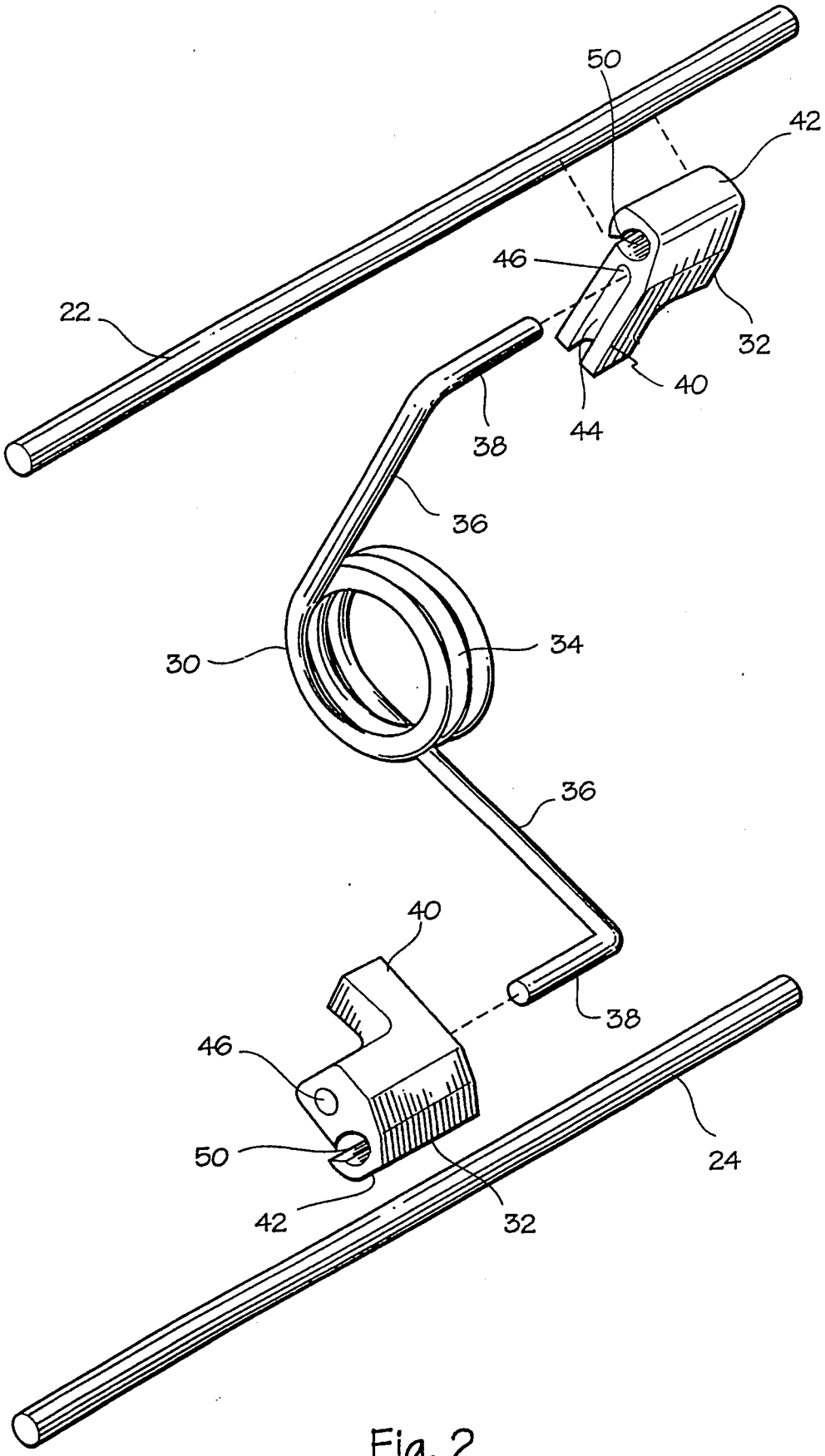
FIG. 2 is an enlarged perspective view, in exploded form, showing one perimeter support spring according to the present invention.
Figure 3:
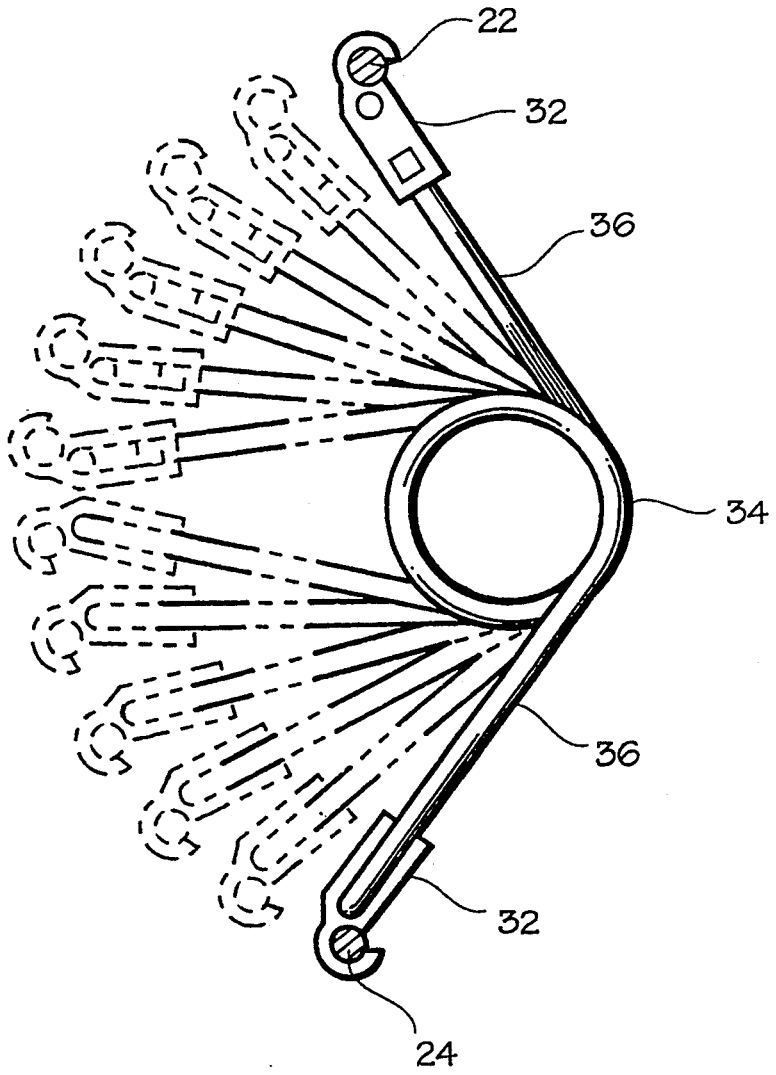
FIG. 3 is a side elevational view of the perimeter support spring of FIG. 2, in assembled form as installed on the border wires of a mattress.

As best seen in FIGS. 2 and 3, each perimeter support spring 18 of the present invention includes a spring member 30 to which a pair of plastic mounting clips 32 are attached. The spring member 30 is formed of a continuous length of spring metal rod stock coiled centrally along its length to form a torsion coil 34, with the remaining lengthwise segments of the spring steel rod extending divergingly from the torsion coil 34 to form a pair of opposed linear spring arms 36. The outward free end 38 of each spring arm 36 is bent laterally in substantially perpendicular relation to the spring arm 36, with the respective free ends of the two spring arms extending oppositely to one another. Of course, it will be understood that other forms of spring members using a spring element other than a torsion coil could be equally well employed in the present perimeter support spring, the torsion spring member 30 merely being illustrative and exemplary.

Figure 4:
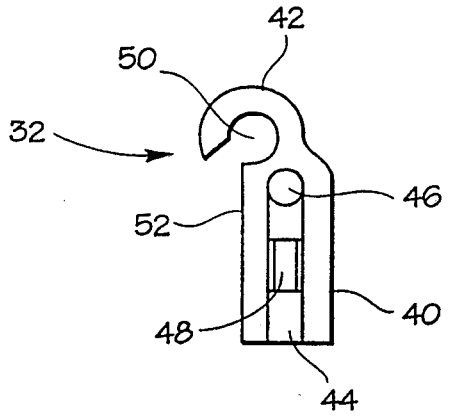
FIG. 4 is a side elevational view of one mounting clip of the present perimeter support spring.
Figure 5:
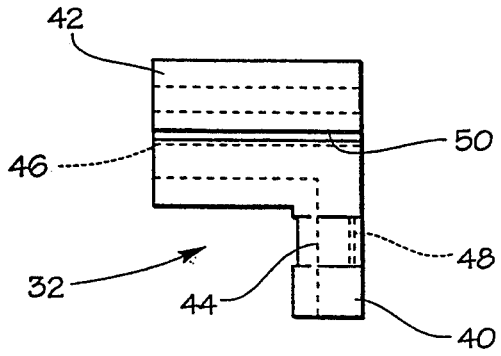
FIG. 5 is a front elevational view of the mounting clip of FIG. 4.
Figure 6:
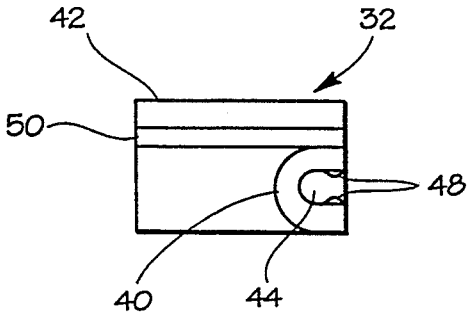
FIG. 6 is a bottom plan view of the mounting clip of FIG. 4.

Each mounting clip 32 is fabricated in a generally L-shaped configuration forming a first attachment portion 40 for receiving the free end 38 of one torsion spring arm 36 and a second attachment portion 42 for receiving a respective border wire 22,24. The first attachment portion 40 comprises a channel 44 formed lengthwise in and opening laterally outwardly along one leg of the L-shaped mounting clip 32 and a bore 46 extending from the inwardmost terminal end of the channel 44 perpendicularly through the length of the other leg of the L-shaped mounting clip 32. As best seen in FIGS. 4–6, the channel 44 is of a rounded configuration conforming to that of the torsion spring arms 36, with opposing ears 48 projecting inwardly toward one another along a portion of the channel 44 to form arm retainer portions. The second attachment portion 42 comprises another channel 50 formed longitudinally in and opening laterally along the same leg of the mounting clip 32 as the bore 46, in parallel relation to the bore 46. As seen in FIG. 4, the channel 50 is also of a rounded configuration conforming to that of the border wires 22,24. Also, the channel 50 is offset from the channel 44 and the bore 46 of the first attachment portion 40 so as to be out of alignment with the respective spring arm 36 when attached thereto (see FIGS. 3, 4 and 6).

The mounting clips 32 are preferably fabricated of a moldable or castable thermoplastic material, such as polypropylene, to facilitate economical manufacture and also to provide a desired degree of resiliency for snap-fitting of the spring arms 36 and the border wires 22,24 into the respective channels 44,50, as described hereinafter.

Assembly and installation of the perimeter support spring 18 of the present invention may thus be understood. Initially, a mounting clip 32 is attached to each spring arm 36 of the torsion spring member 30 by extending the free end 38 of the spring arm 36 through the entire length of the bore 46 in the mounting clip's first attachment portion 40 until the adjacent portion of the spring arm 36 is received within the channel 44. The retaining ears 48 are sufficiently resilient to yield to the spring arm 36 and then to return to a retaining disposition holding the spring arm 36 within the channel 44. With the perimeter support spring 18 thusly assembled, installation is accomplished by snapping the second attachment portion 42 of each mounting clip 32 onto a respective one of the upper and lower border wires 22,24 of the spring assembly 16. The attachment portion 42 is sufficiently resilient to expand as the border wire enters the channel 50 and then to return to its original shape to retain the border wire within the channel 50. Notably, as seen in FIGS. 3 and 4, the forward face 52 of the mounting clip 32 along the first and second attachment portions 40,42 beneath the channel 50 provides a substantially smooth, flat surface aligned with the entrance to the channel 50 to assist in directing the border wire into the channel 50 during installation.

With reference to FIG. 3, it will be seen that, once the perimeter support spring 18 of the present invention is thusly installed, the offset of the channel 50 of the attachment portion 42 from the channel 44 and bore 46 of the attachment portion 40 serves to orient the border wires 22,24 and the ends 38 of the torsion spring member 30 substantially co-planar with one another when the mattress spring assembly 16 is at rest, i.e., uncompressed, as shown in full lines in FIG. 3, and also during the initial stages of compression, as shown in broken lines in FIG. 3. As the mattress spring assembly 16 compresses, the channel 44 and the bore 46 of the attachment portion 42 maintains each mounting clip 32 substantially rigid with respect to the opposed spring arms 36 of the torsion spring member 30, while the channel 50 of the attachment portion 42 permits each mounting clip 32 to rotate about the border wires 22,24 as they approach one another during compression and as they move away from one another during decompression of the spring assembly 16. As a result, the exertion of compressive forces on the perimeter of the spring assembly 16 serves to continuously urge the border wires 22,24 into the respective channels 50 of the mounting clips 32, thereby to resist detachment of the perimeter support springs 18 from the border wires 22,24. In addition, since the free ends 38 of the spring arms 36 are bent in opposite directions from one another, the perimeter support spring 18 is symmetrical so as to simplify installation and, at the same time, the resultantly opposing orientations of the mounting clips 32 serves to resist and minimize twisting of the perimeter support spring 18 during compression and decompression of the spring assembly 16.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spring assembly having an array of coil springs arranged and connected to one another generally in side-by-side parallel relation and upper and lower border wires extending in spaced parallel relation about the lateral perimeter of the spring array and connected to the coil springs along the perimeter of the spring array, and a plurality of perimeter support springs connected to and extending between the border wires, each perimeter support spring comprising a spring member having an intermediate spring element disposed generally between the border wires, a pair of spring arms extending in diverging directions from opposite ends of the spring element to respective terminal arm ends in proximity respectively with the border wires, and a pair of mounting clips attached respectively to the terminal arm ends of the spring arms, each mounting clip having a first attachment portion receiving the respective terminal arm end and a second attachment portion receiving the respective border wire.

2. A spring assembly according to claim 1, wherein the mounting clips hold the terminal arm ends of the spring arms and the border wires generally aligned with one another in a common plane when the perimeter of the spring array is uncompressed and during an initial stage of compression.

3. A spring assembly according to claim 2, wherein the second attachment portion of each mounting clip is offset from the first attachment portion to be out of alignment with the respective spring arm.

4. A spring assembly according to claim 1, wherein the second attachment portion of each mounting clip defines a channel for receiving the respective border wire while permitting relative rotation about the border wire during compression and decompression of the perimeter of the spring array, the first attachment portion of each mounting clip maintaining the clip essentially rigid with respect to the respective spring arm to constrain the channel of the second attachment portion to face the spring array when the perimeter of the spring array is uncompressed and to rotate relative to the respective border wire during compression of the perimeter of the spring array to face oppositely to the direction of the compressive force, whereby compressive forces on the perimeter of the spring array urge the border wires into the respective channels of the mounting clips to resist detachment from the border wires.

5. A spring assembly according to claim 1, wherein each mounting clip is formed of a molded thermoplastic material.

6. A spring assembly according to claim 1, wherein each mounting clip is of an L-shaped configuration having the first and second attachment portions at least partially transverse to one another.

7. A spring assembly according to claim 6, wherein the terminal arm end of each spring arm is oriented generally perpendicularly to the spring arm, the first attachment portion of each mounting clip defines a first opening receiving the respective terminal arm end and a first channel receiving the respective spring arm, and the second attachment portion defines a second channel generally transverse to the first channel receiving the respective border wire.

8. A spring assembly according to claim 7, wherein the terminal arm ends of each perimeter support spring extend in opposite directions to one another.

9. A spring assembly according to claim 1, wherein the spring element of the spring member is a torsion coil.

10. A perimeter support spring for use in a spring assembly of the type comprising an array of interconnected coil springs with upper and lower border wires connected in spaced parallel relation to the coil springs along the lateral perimeter of the spring array, wherein the perimeter support spring may be connected between the border wires to provide supplementary resilient support therebetween, the perimeter support spring comprising a spring member having an intermediate spring element, a pair of spring arms extending in diverging directions from opposite ends of the spring element to respective terminal arm ends, and a pair of mounting clips attached respectively to the terminal arm ends of the spring arms, each mounting clip having a first attachment portion receiving the respective terminal arm end and a second attachment portion for receiving a respective border wire.

11. A perimeter support spring according to claim 10, wherein the second attachment portion of each mounting clip is offset from the first attachment portion to be out of alignment with the respective spring arm for holding the terminal arm ends of the spring arms and the border wires generally aligned with one another in a common plane when the perimeter of the spring array is uncompressed and during an initial stage of compression.

12. A perimeter support spring according to claim 10, wherein the second attachment portion of each mounting clip defines a channel for receiving the respective border wire while permitting relative rotation about the border wire during compression and decompression of the perimeter of the spring array, the first attachment portion of each mounting clip maintaining the clip essentially rigid with respect to the respective spring arm to constrain the channel of the second attachment portion to face the spring array when the perimeter of the spring array is uncompressed and to rotate relative to the respective border wire during compression of the perimeter of the spring array to face oppositely to the direction of the compressive force, whereby compressive forces on the perimeter of the spring array urge the border wires into the respective channels of the mounting clips to resist detachment from the border wires.

13. A perimeter support spring according to claim 10, wherein each mounting clip is formed of a molded thermoplastic material.

14. A perimeter support spring according to claim 10, wherein each mounting clip is of an L-shaped configuration having the first and second attachment portions at least partially transverse to one another.

15. A perimeter support spring according to claim 14, wherein the terminal arm end of each spring arm is oriented generally perpendicularly to the spring arm, the first attachment portion of each mounted clip defines a first opening receiving the respective terminal arm end and a first channel receiving the respective spring arm, and the second attachment portion defines a second channel generally transverse to the first channel for receiving the respective border wire.

16. A perimeter support spring according to claim 10, wherein the terminal arm ends of each perimeter support spring extend in opposite directions to one another.

17. A perimeter support spring according to claim 10, wherein the spring element of the spring member is a tension coil.

* * * * *